US007325267B2

(12) United States Patent
Slettaøyen

(10) Patent No.: US 7,325,267 B2
(45) Date of Patent: Feb. 5, 2008

(54) FRAME MATTRESS

(75) Inventor: Odd Slettaøyen, Åndalsnes (NO)

(73) Assignee: Wonderland AS, Andalsnes (NO)

( * ) Notice: Subject to any disclaimer, the term of this patent is extended or adjusted under 35 U.S.C. 154(b) by 31 days.

(21) Appl. No.: 10/563,684

(22) PCT Filed: Jul. 15, 2004

(86) PCT No.: PCT/NO2004/000218

§ 371 (c)(1),
(2), (4) Date: Jan. 6, 2006

(87) PCT Pub. No.: WO2005/004675

PCT Pub. Date: Jan. 30, 2005

(65) Prior Publication Data

US 2006/0185084 A1 Aug. 24, 2006

(30) Foreign Application Priority Data

Jul. 15, 2003 (NO) ..... 20033209

(51) Int. Cl.
*A47C 23/05* (2006.01)

(52) U.S. Cl. ..... 5/716; 5/717; 5/720; 5/737; 5/738; 5/722

(58) Field of Classification Search ..... 5/249, 5/260, 716, 717, 720, 722, 727, 737, 738
See application file for complete search history.

(56) References Cited

U.S. PATENT DOCUMENTS 2,860,352 A 11/1958 Pierre
3,066,323 A 12/1962 Kintner
3,153,249 A 10/1964 Janapol
3,680,156 A 8/1972 McKee et al.
3,950,800 A * 4/1976 Garshfield ..... 5/738
4,274,169 A 6/1981 Standiford
4,449,261 A * 5/1984 Magnusson ..... 5/722
4,541,137 A 9/1985 Murray
5,231,714 A 8/1993 Mossbeck
5,432,964 A * 7/1995 Strell ..... 5/716
5,471,688 A * 12/1995 Cavazos ..... 5/251

(Continued)

FOREIGN PATENT DOCUMENTS

CH 452823 5/1968

(Continued)

OTHER PUBLICATIONS

International Search Report for International Application No. PCT/NO 96/00049 dated Jun. 24, 1996.

(Continued)

*Primary Examiner*—Michael Trettel
(74) *Attorney, Agent, or Firm*—Kolisch Hartwell, P.C.

(57) ABSTRACT

The present invention concerns a frame mattress comprising a frame (1) with a spring inlay (3) surrounded by the frame, and a material (2) over the spring inlay, together with a reversible mattress (5), arranged for abutting the material (2), and a cover (7) enveloping the reversible mattress (5) and at least partly the frame (1), characterised in that the material (2) is at least partly detachable and that the spring inlay (3), constituting a principally form stable unit, is reversibly arranged in the frame (1).

10 Claims, 2 Drawing Sheets

U.S. PATENT DOCUMENTS

Figure 1:
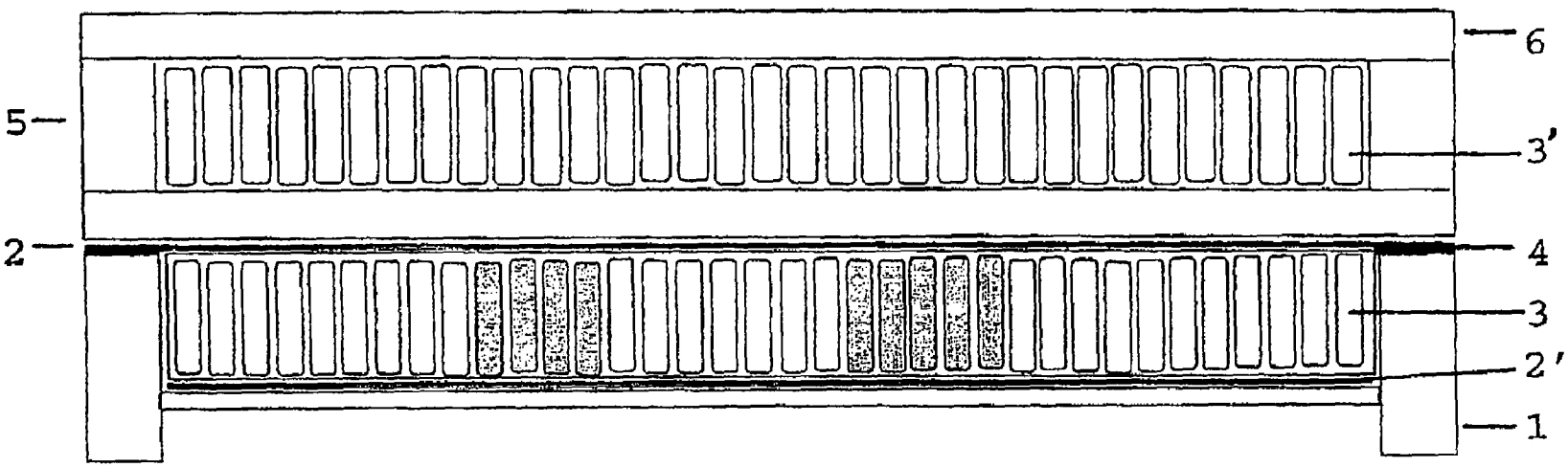

| | | | | |
|---|---|---|---|---|
| 6,233,760 | B1 * | 5/2001 | Cavazos | 5/248 |
| 6,370,717 | B1 * | 4/2002 | Kao | 5/723 |

FOREIGN PATENT DOCUMENTS

| | | |
|---|---|---|
| EP | 0813379 | 3/2003 |
| FR | 1451934 | 11/1965 |
| FR | 2602962 | 2/1988 |
| NO | 144509 | 6/1981 |
| NO | 149198 | 11/1983 |
| SE | 388346 | 10/1976 |

OTHER PUBLICATIONS

Revised version of the International Search Report for International Application No. PCT/NO 96/00049 dated Apr. 29, 1997.

Norwegian Search Report for Patent Application No. 20032209 dated Mar. 10, 2004.

* cited by examiner

FRAME MATTRESS

The present invention relates to a novel frame mattress of the kind defined in the preamble of claim 1.

BACKGROUND OF THE INVENTION

Beds and mattresses are an important part of our everyday life. Their main function is to provide each individual a good rest and sleep. It is therefore of utmost importance that they are constructed in such a way that each individuals' rest in bed is optimal throughout the total resting period. In order to achieve this, the construction of the bed must be such that a correct resting position and good pressure-relief for the whole body is achieved. The spinal column and the joints should rest in their natural positions in order that the muscles are strained as little as possible, and such that the blood circulation throughout the body becomes optimal. If the body is not provided with sufficient support during rest, new positions are often assumed to avoid stiffness and pins and needles (numbness) in the arms and legs. By repeated change of positions, the quality of sleep is reduced and the person will not be sufficiently rested. In the worst case scenario, insufficient support and poor sleeping position may give a stiff and sore neck, back ache, sore hip joints, numb arms and legs.

It has long been recommended by suppliers of ordinary reversible mattresses, placed on bed boards in ordinary beds, to turn the mattress at least once a year. The materials thereby obtain the time to recover on the used side, and the lifetime of the mattress is extended. Further, it is also recommended that the bed is cleaned in a god way to remove mite an especially excrements from mite which may give allergies. For good cleaning, vacuuming of the cover, bed, bed board and mattress is included, and not least washing the bed covers.

Frame mattresses are well known products in Scandinavia, and there are several different frame mattress models, amongst which the following may be mentioned:

DE 25 36 882 describes a standard frame mattress wherein a spring mattress is arranged on a plate over a frame and permanently combined with the plate. The frame does not contain a spring inlay and the spring mattress is not detachable or reversible, but the mattress cover is detachably attached to the frame. However, the patent does not describe a mattress which may be turned when the mattress cover is removed because the mattress springs are fastened to the base plate which is placed on top of the frame.

The frame mattress described in Norwegian patent no. 307641 is considered to constitute the closest prior art. This frame mattress is comprised of a frame wherein a spring inlay is fastened in a frame and covered with a material fastened to the frame, and a reversible mattress arranged for abutting the material, and wherein a cover is detachably mounted over the mattress and partly around the frame. In NO 307641, one was able to produce a frame mattress wherein the removal of the cover and the turning of the mattress, constituting the upper part of the frame mattress, was possible.

The present invention distinguishes itself from the frame mattress described in NO 307641 on several accounts and will be described in greater detail below.

The present invention solves the above mentioned problems regarding a high level of resting comfort while simultaneously achieving increased lifetime of the product, which furthermore may easily be maintained and completely cleaned.

More specifically, the present invention relates to a frame mattress comprising a frame (1) with a spring inlay (3) surrounded by the frame, and a material (2) over the spring inlay, together with a reversible mattress (5), arranged for abutting the material (2), and a cover (7) enveloping the reversible mattress (5) and at least partly the frame (1), wherein the material (2) is at least partly detachable and the spring inlay (3), constituting a principally form stable unit, is reversible arranged in the frame (1).

The invention is further illustrated by the following attached Figures wherein:

FIG. 1 depicts a schematic, vertical, longitudinal section of the frame mattress according to the present invention comprising the supporting frame (1), wherein a material (2') is fastened onto which a spring inlay (3) is placed, covered by a material (2). The material (2) is fastened to the frame (1) by a fastening means (4). Onto the material (2) a reversible mattress (5) is placed which may comprise a spring core (3'), padding and side edges (6).

Figure 2:
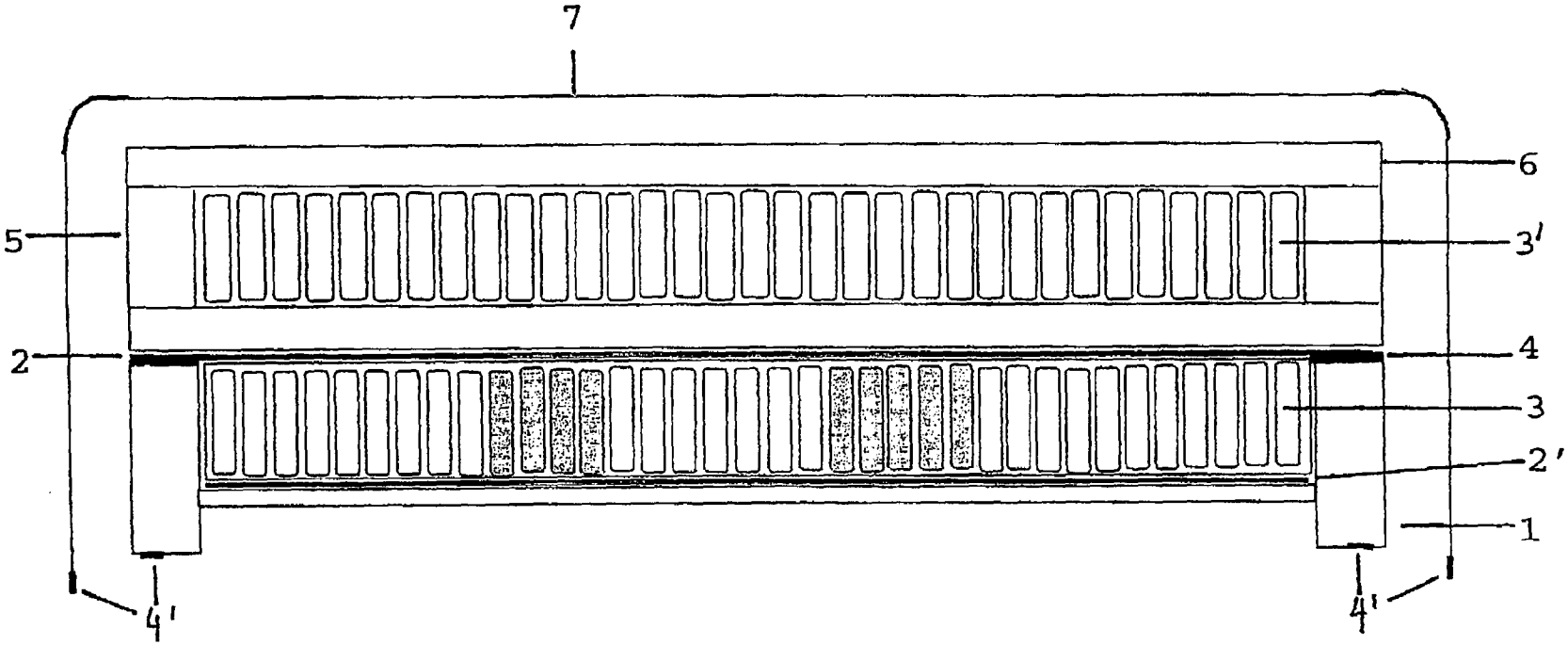

FIG. 2 shows how the adapted cover (7) is mounted over the entire construction and fastened by the fastening means (4'). One part of the fastening means is stapled to the underside of the frame (1), and the facing part is sewn to the cover (7). This Figure illustrates the whole construction.

The supporting frame is constructed of a rigid and stable material, such as wood.

The materials (2') and (2) are of a material such as Vliseline. The material (2') is fastened by fastening means such as for example with hook and loop fasteners (e.g. Velcro) to the bottom of the frame (1), while the material (2) is mounted detachably to the top of the frame. The material (2) is at least partly releasable so that it may be folded aside or possibly removed entirely. The material is preferably fastened by fastening means (4) such as by hook and loop fasteners, snap fasteners, zippers etc., preferably hook and loop fasteners, with one part fastened to the frame (1), for example by stapling or gluing, while the facing part is fastened to the material (2), for example by a seam. Alternatively, the material or parts of the same may be fasted to the frame by for example hook and loop fasteners attached to the frame and material respectively. The material (2') may be removed and alternatively replaced.

The reversible spring inlay (3) is constituted of low pocket-springs, i.e. individual springs sewn into textile bags. This system provides unique comfort as each individual spring reacts to body pressure independently of the adjacent springs. All the individual springs in the spring inlay may either be equally stressed or may preferably be divided into zones of different stress levels, such that zone partitioning is achieved, wherein different parts of the spring inlay have different stress-levels, achieving different bed firmness. The zones are for example adapted so that the protruding parts of the body such as the shoulders and hips, rest against softer springs than other parts of the body. In this way, less pressure is put on the shoulders and hips, and the body is provided with an even pressure load and good support at the same time. The spring inlay constitutes a principally form-stable unit which may be removed from the frame and turned in one or more parts. The spring inlay may for example consist of separate units for each comfort zone, such that a broken or worn zone may be replaced or changed separately. This also enables the bed to be adapted to the user individually by altering the length and firmness of the zones, for example. The pocket springs are in bags adhered to each other by being glued together at each point of contact, for example by melting glue. The spring inlay(s) may be of pocket springs or other types of springs known in the art.

The reversible mattress (5) is an ordinary mattress as such, comprising a spring core (3'), padding (6), side edges enveloped in a mattress cover. The spring core (3') may consist of traditionally employed spring types such as Bonell-springs, LFK-springs and Pocket-springs such as the spring core (3) above, independently chosen in relation to the same. In the padding and side edges (6), all known types of padding material may be used, such as fibres, foamed plastic and foamed rubber. The reversible mattress may of course also contain a zone division consisting of springs with different stiffness, possibly in separate units as described over.

The cover (7) is form adapted and mounted detachably over the entire construction so that it encompasses both the reversible mattress and at least partly the frame, and is attached by fastening means (4'), preferably by hook and loop fasteners to the frame (1). Preferably, one part of the hook and loop fastener is stapled to the underside of the frame, whereas the counterpart is sewn onto the cover.

The frame mattress according to the present invention will ensure that the bed may be cleaned thoroughly in a far better way than earlier, since the material (2) may also be removed from the supporting frame (1), and in that all the main components of the bed are replaceable. It is novel in relation to the prior art technique, that the material, may at least partly be disconnected from the frame. Preferably, the material is removed completely from the frame. When the material is removed from the supporting frame, the spring inlay may be removed and turned or replaced as mentioned. The lifetime of the spring inlay and thus also the lifetime of the bed, may be approximately doubled when the springs are allowed to recover on the side not facing up, and at the same time the inner part and the base of the frame may be cleaned when the spring inlay is removed. Any change in the needs/desires of the user with regard to the firmness of mattress/bed caused by, for example altered body weight, may be addressed by individual or complete replacement of the spring cores.

The frame mattress as described above according to the present invention, will possess a double-spring effect. The purpose of the bottom spring so as to increase the spring depth of the frame mattress, thereby ensuring that the heavier parts of the body enter sufficiently into the mattress, and in this manner reduce the counter pressure from the bed against the body. The result is increased resting comfort and that blood circulation is not hindered when resting. It should be pointed out that it is novel to use a spring inlay with zone division in the frame. It has long been known that ordinary reversible mattresses, which are placed on bed rests in ordinary beds, may have a zone division of firm or soft spring zones, but this type of zone division has not been contemplated or used as spring inlay, neither detached nor fastened to the frame of a frame mattress. Prior frame mattresses were made in a manner wherein the spring inlay in the supporting frame was fastened to the bottom of the frame.

Briefly summarised, the present invention differs from the prior art technique in that:

the material may be removed from the frame (1), the spring inlay (3) in the frame (1) lies unattached and may be removed and turned, the spring inlay (3) in the frame (1) may be zone divided with alternating stiff and soft springs, the zones may be separate units.

The present frame mattress has the improved properties in relation to:

1) hygiene as the cover (7) and the materials (2 and 2') in the frame all may be removed and washed. This also makes it possible to gain access, so that the mattress resting on the frame may be vacuumed as well as the spring inlay, and possibly be removed so that the bottom of the frame may also be cleaned. Thorough cleaning is especially important in view of contagious diseases and allergies;
2) resting comfort is increased as the spring inlay may have zone divisions of softer and firmer springs;
3) the lifetime of the product is increased considerably, maybe to the double, because both the mattress resting on the frame and the spring inlay may be turned, such that the sides that have been used may retract when they no longer face up towards the individual. Alternatively the mattress and/or spring inlay may be replaced separately; and
4) flexibility in the choice of mattress and spring inlay for the consumer who may thereby obtain a custom adapted frame mattress.

The invention claimed is:

1. A frame mattress comprising a frame with a spring inlay surrounded by the frame, and a material over the spring inlay, together with a reversible mattress, arranged for abutting the material, and a cover enveloping the reversible mattress and at least partly the frame, characterized in that the material mounted to the entire top of the frame is at least partly detachable and that the spring inlay, constituting a principally form-stable unit of separate spring elements, is reversibly arranged in the frame.

2. A frame mattress according to claim 1, characterised in that the spring inlay has a zone division of the springs in soft and firm zones.

3. A frame mattress according to claim 2, characterised in that the spring inlay has a zone division consisting of separate spring elements.

4. A frame mattress according to any one of claims 1-3, characterised in that the spring inlay consists of Pocket-springs.

5. A frame mattress according to any one of claims 1-3, characterised in that the material is detachably fastened to the frame with fastening means, with one part of the fastening means fastened to the frame, and a facing part of the fastening means fastened to the material.

6. A frame mattress according to claim 5, characterised in that the fastening means is a hook and loop fastener, snap fastener or zipper.

7. A frame mattress according to any one of claims 1-3, characterised in that a second material is fastened permanently or detachably between the bottom of the frame and the spring inlay.

8. A Frame mattress according to claim 5, characterised in that the one part of the material is fastened to the frame by stapling.

9. A frame mattress according to claim 5, characterised in that the facing part is fastened to the material by a seam.

10. A frame mattress according to claim 6, characterised in that the fastening means is a hook and loop fastener.

* * * * *